US009624010B2

(12) United States Patent
Harper

(10) Patent No.: US 9,624,010 B2
(45) Date of Patent: Apr. 18, 2017

(54) DISPENSING CLOSURE ARRANGEMENT FOR A CONTAINER

(71) Applicant: HARFORD INVESTMENTS LTD, Leicestershire (GB)

(72) Inventor: James Barrie Harper, Marbella (ES)

(73) Assignee: HARFORD INVESTMENTS LTD, Leicestershire (GB)

( * ) Notice: Subject to any disclaimer, the term of this patent is extended or adjusted under 35 U.S.C. 154(b) by 0 days.

(21) Appl. No.: 14/402,065

(22) PCT Filed: May 21, 2013

(86) PCT No.: PCT/EP2013/060429
§ 371 (c)(1),
(2) Date: Nov. 18, 2014

(87) PCT Pub. No.: WO2013/171344
PCT Pub. Date: Nov. 21, 2013

(65) Prior Publication Data

US 2015/0144665 A1 May 28, 2015

(30) Foreign Application Priority Data

May 18, 2012 (GB) ..... 1208787.0

(51) Int. Cl.
*B65D 47/12* (2006.01)
*B65D 47/06* (2006.01)
(Continued)

(52) U.S. Cl.
CPC ..... *B65D 47/122* (2013.01); *B65D 47/065* (2013.01); *B65D 47/242* (2013.01);
(Continued)

(58) Field of Classification Search
CPC ..... B65D 47/06; B65D 1/06; B65D 1/023; B65D 1/0223; B65D 47/241–47/242;
(Continued)

(56) References Cited

U.S. PATENT DOCUMENTS 1,100,536 A * 6/1914 Clarke ..... 222/564
2,998,170 A * 8/1961 Manzione et al. ..... 222/520
(Continued)

FOREIGN PATENT DOCUMENTS

| | | |
|---|---|---|
| FR | 2167305 | 8/1973 |
| GB | 600978 | 4/1948 |
| GB | 1369539 | 10/1974 |

*Primary Examiner* — Paul R Durand
*Assistant Examiner* — Andrew P Bainbridge
(74) *Attorney, Agent, or Firm* — Maschoff Brennan

(57) ABSTRACT

A closure arrangement for a liquid container comprises a container neck and a cap, a threaded portion and a closure portion for closing a bore of the neck when the cap is closed. The closure portion comprises a plurality of apertures. It engages prevents liquid flow through the apertures when the cap is closed. Another closure arrangement may comprise a first opening and a second opening for venting air into the container; a spout being movably mounted to the container and movable between first and second relative positions; such that in the first position of the spout, the air vent is open and liquid may be poured from the container through the spout and in a second position, the first and second openings are closed by sealing engagement with the spout.

19 Claims, 14 Drawing Sheets

(51) Int. Cl.

| | |
|---|---|
| ***B65D 47/24*** | (2006.01) |
| *B65D 25/32* | (2006.01) |
| *B65D 25/28* | (2006.01) |
| *B65D 25/42* | (2006.01) |
| *B65D 25/48* | (2006.01) |
| *B65D 41/04* | (2006.01) |
| *B65D 51/16* | (2006.01) |
| *B65D 53/02* | (2006.01) |

(52) U.S. Cl.
CPC ..... *B65D 25/2835* (2013.01); *B65D 25/2894* (2013.01); *B65D 25/32* (2013.01); *B65D 25/42* (2013.01); *B65D 25/48* (2013.01); *B65D 41/0414* (2013.01); *B65D 41/0442* (2013.01); *B65D 51/16* (2013.01); *B65D 53/02* (2013.01)

(58) Field of Classification Search
CPC .... B65D 47/261; B65D 47/263; B65D 25/42; B65D 25/48; B65D 25/2894; B65D 25/2835; B65D 47/065; B65D 47/122; B65D 47/32; B67D 3/00
USPC ..... 222/519–521, 547, 564, 465.1–475.1, 222/468, 475
See application file for complete search history.

(56) References Cited

U.S. PATENT DOCUMENTS 3,240,404 A * 3/1966 Porter ..... B65D 47/242 222/521
3,351,249 A 11/1967 Stull
3,407,967 A * 10/1968 Stull ..... 222/48
3,422,998 A * 1/1969 Murray ..... 222/567
3,809,275 A * 5/1974 Ek ..... B65D 39/08 215/12.1
3,834,596 A * 9/1974 Brady ..... B65D 47/242 222/520
3,980,110 A * 9/1976 Cain et al. ..... 141/351
4,568,004 A * 2/1986 Goncalves ..... B65D 47/242 222/207
4,799,598 A * 1/1989 McFadyen ..... B65D 50/041 215/260
4,836,416 A * 6/1989 Shalgi ..... A45F 3/20 222/105
5,110,017 A * 5/1992 Braun ..... A45D 34/041 215/218
5,402,920 A * 4/1995 Dhillon ..... B67D 3/00 141/351
6,056,161 A * 5/2000 Brown ..... B65D 41/48 222/153.14
6,202,871 B1 * 3/2001 Kelly ..... B65D 41/3423 215/307
6,230,944 B1 * 5/2001 Castellano et al. ..... 222/481.5
6,997,359 B2 * 2/2006 Boggs ..... B65D 47/127 222/520
8,272,543 B2 * 9/2012 Yang ..... B65D 47/242 222/153.01
8,833,617 B1 * 9/2014 Compton ..... B65D 47/065 222/153.14
2011/0068134 A1 * 3/2011 Yang ..... B65D 47/242 222/519
2011/0204098 A1 * 8/2011 Chen ..... B65D 47/242 222/519

* cited by examiner

DISPENSING CLOSURE ARRANGEMENT FOR A CONTAINER

FIELD OF THE INVENTION

The present invention relates to liquid containers and closures for liquid containers. More particularly, the invention relates to containers having novel reclosable closures, which may be adapted for use with various fluids, including flammable fluids such as petrol. The invention may be applied in the field of petrol cans or 'jerry cans', used for filling the fuel tank of a motorised vehicle.

BACKGROUND

It is well known to provide petrol cans to motorists or individuals wishing to transport petrol from a petrol pump to any kind of motorised vehicle, such as a lawnmower, tractor and occasionally to a broken down car. Emergency breakdown services occasionally carry cans full of fuel for refuelling motorists who have run out of fuel away from home. Known fuel cans generally have a single opening through which liquid may be poured into or out of the container and a separately attachable spout for attachment to the opening as an extension, to pour the liquid more directly into the fuel tank of the vehicle. There is a need for an improved closure device for such containers to simplify the transition from a sealed transporting configuration into an open, pouring, configuration of the container. Such closures can also be useful in other areas where fluids are temporarily transported in containers and where it is desired to facilitate fast, convenient, safe and controlled release of the fluid from the container.

SUMMARY

According to the present invention there is provided a closure arrangement for a liquid container comprising:

- a neck comprising:
  - a bore; and
  - a thread, for threaded engagement with a cap;
- a cap comprising:
  - a threaded portion; and
  - a closure portion configured to close the bore of the neck when the cap is held in a closed position by the thread;
  - a plurality of apertures for the passage of liquid; and
  - a spout formed integrally with the cap and arranged to collect and direct flow from the apertures;

and

- sealing means, arranged to prevent liquid from exiting the container via the threads;
  - the closure portion, being arranged to engage the neck, to prevent fluid flow through the apertures when the cap is in the closed position.

The closure arrangement of the present invention, on rotation of the cap relative to the neck, reveals a pathway from the interior of the container through multiple apertures in a closure, and has an integral spout which can bring together, under gravity during pouring, the multiple streams of liquid dispensed through the apertures into the spout in a single, well directed flow whilst simultaneously allowing air to enter the container to replace the liquid already dispensed.

The apertures may be arranged such that at least a proportion of the apertures are arranged substantially opposite one another. This allows air to enter a container having the closure arrangement through an upper set of apertures during pouring to replace fluid exiting the container through lower apertures during pouring, while the multiple streams are gathered via a spout.

The closure portion may be arranged to engage an end portion of the neck.

The closure portion may be formed either integrally with the cap or as a separate component.

The closure portion may comprise a sealing portion for engagement with the neck to close a flow path from the bore of the neck to the apertures.

The apertures may be located at a smaller diameter than that of the neck or of its bore.

A void may be provided in the closing portion to provide a flow path from the sealing edge to the apertures located at a smaller diameter on the closing portion than that of the sealing edge.

The cap may comprise a spout comprising at least one wall parallel to the threaded portion.

The spout may comprise an outlet orifice having a diameter at least as great as that of the outer diameter of the array of apertures.

The cap may comprise no enclosed volumes.

At least one of the thread of the cap or the thread of the neck may be a single start thread.

At least one of the threads of the cap or the neck may be arranged such that a half-turn, a three-quarter turn, or a full turn of the cap from its closed position opens a flow path through the apertures smaller than the flow path through the neck.

The cap may further comprise an outlet orifice and a chamber between the closure portion and the outlet orifice.

The plurality of apertures may have a flow area for the passage of liquid at least substantially equal to the flow area of the outlet orifice.

At least one of the neck and the cap may comprise a multi-start thread.

At least one of the threads of the cap or the neck, may be arranged such that a half-turn of the cap from its closed position opens a flow path through the apertures at least substantially equal to the flow path through the outlet orifice.

The outlet orifice may have a flow area greater than around half the flow area of the bore of the neck, preferably greater than around ¾ of the flow area of the bore of the neck, more preferably greater than around ⅚ of the flow area of the bore of the neck.

At least one of the neck and the cap may comprise a thread arranged such that turning the cap from the closed position through between a half and a full turn releases the cap from the neck.

The apertures may be arranged to engage an end portion of the neck, such that the end portion of the neck substantially seals the apertures of the closure portion when the cap is screwed on to the thread.

The closure portion comprises bore sealing means arranged to seal the bore of the neck when the cap is in the closed position.

The sealing means may be provided by the threads of the cap and the neck being configured to have an interference-fit, such that the threads of the neck and cap are substantially liquid-tight when engaged with one another.

The sealing means may be provided as a separate sealing member between the cap and the neck.

The closure portion may be a separate component from the threaded portion and may be engaged thereto by engagement means, such as by an interference fit, by threaded engagement, by fastenings, or by adhesive.

The neck may be integrally formed on a liquid container, which may be a fuel can.

The invention further provides a liquid container comprising a body and a spout;

the body comprising:

a first opening for filling or pouring liquid from the container;

a second opening for venting air into the container;

the spout being movably mounted to the container and movable between first and second positions;

the spout and first and second openings being arranged such that:

in the first position of the spout, the second opening is open and liquid may be poured from the container through the spout; and in a second position, the first and second openings are closed by sealing engagement with the spout.

The spout may be in threaded engagement with the first opening of the body.

The spout may be arranged to be rotatable from the first position to the second position.

The liquid container may comprise a closure arrangement according to the present invention, the container body comprising the neck and the spout comprising the cap.

The spout may comprise a protrusion arranged to enter the second opening to prevent passage of air through the opening.

The second opening may comprise a resilient seal.

The container may comprise spout retaining means for retaining the spout in the second position.

The spout retaining means may be formed on the spout and on the body of the container.

The retention means may comprise a container extension for surrounding at least a part of the spout and releasable engagement means for engaging the spout with the container extension.

The container may further comprise spout retention means configured to retain the spout in its open position.

BRIEF DESCRIPTION OF THE DRAWINGS

Specific embodiments of the present invention will be described with reference to the following figures in which.

DETAILED DESCRIPTION

Figure 1:
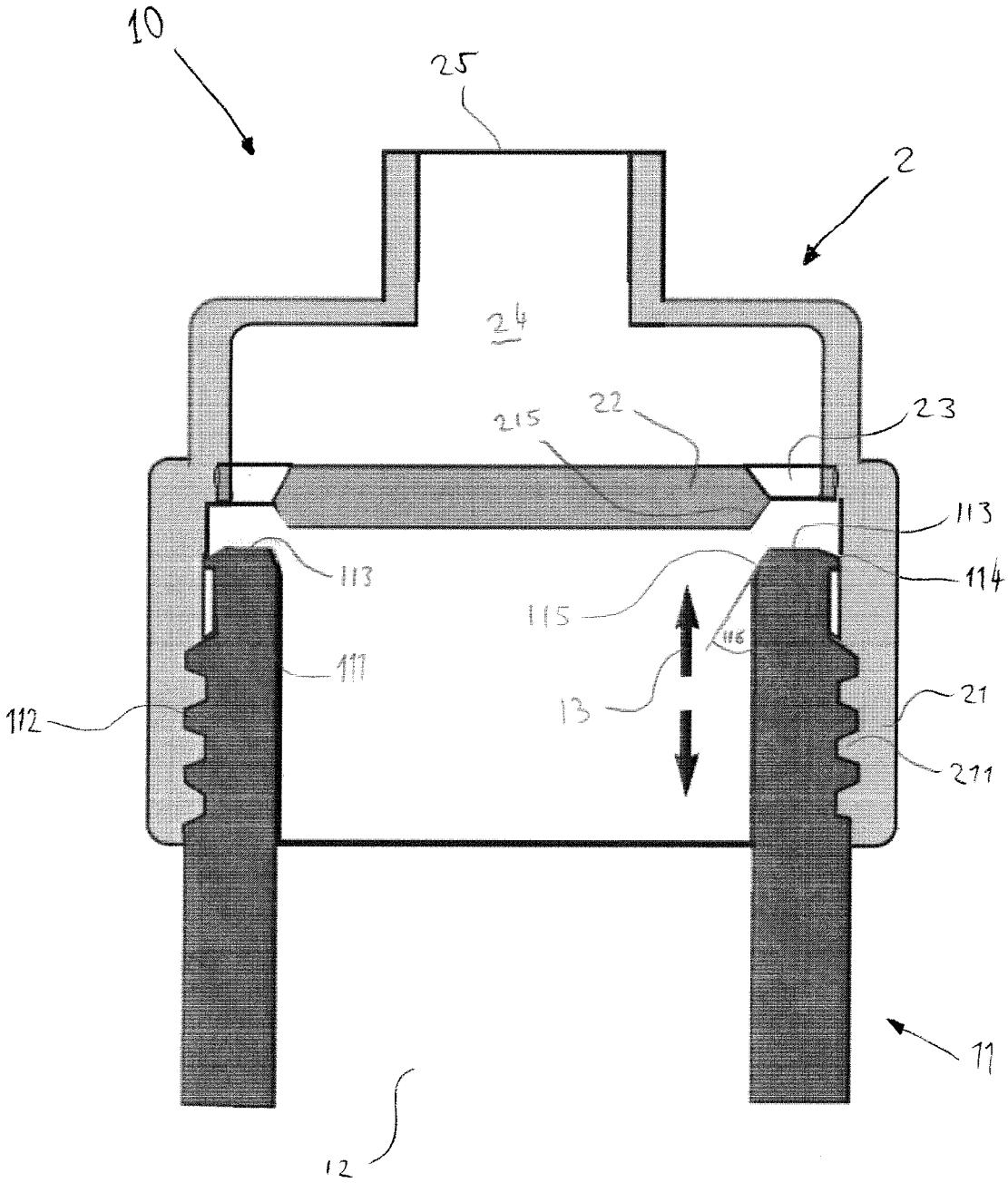
FIG. 1 shows a closure arrangement incorporating features of the invention.

FIG. 1 illustrates a closure arrangement 10 according to an aspect of the present invention. The arrangement comprises a neck 11 having a bore 12 disposed therein. The neck 11 further comprises a threaded portion 111 comprising a thread 112. An end portion 113 of the neck is located at a distal end of the neck.

The arrangement further comprises a cap 2 comprising a threaded portion 21, which is provided with a thread 211. A closure portion 22 is configured relative to the threaded portion 21 such that when the threaded portion 21 is engaged with the threaded portion 111 of neck 11, closure portion 22 can substantially seal an end of bore 12 of the neck 11 in a closed position. The closure portion 22 further comprises a plurality of apertures 23. The apertures are arranged substantially in alignment with end portion 113 of neck 11. This can allow the end portion 113 to substantially seal apertures 23 when cap 2 is screwed into a closed position on threads 211 and 112. The cap may be moved between an open position and closed position by rotation of the cap on its threads relative to the neck. In the open position, fluid is free to flow through apertures 23.

Fluid is intended to pass out of the bore 12 through chamber 24 and out via outlet orifice 25 of the cap 2. It is therefore important that liquid is prevented from passing along threads 112 and 211 so that fluid exiting the bore 12 is directed through outlet orifice 25 of cap 2. Threads 211 and 112 may therefore be configured such that they engage with an interference-fit. This can prevent any fluid passing from the bore 12 to the outside of the neck 11 via the threads. Additionally, or alternatively, a sealing feature 114 may be provided on the neck to may engage with cap 2 in an interference-fit to provide a sealing function to prevent fluids from passing from bore 12 to the exterior of the neck via the threads. Closure portion 22 may further be sized and dimensioned to substantially seal the open end of neck 11 at its end points 113.

Apertures 23 may be sized and dimensioned to allow a flow area through the apertures 23 approximately equal to the flow area through the outlet orifice 25.

A chamfer 115 may be provided on end portion 113 of neck 11. A corresponding chamfer at sealing edge 215 may be provided on closure portion 22. This chamfer can assist in increasing the sealing force provided between the closure portion 22 and neck 11 to provide a more effective seal. An angle 116 of the chamfer may be chosen to provide the best balance of sealing performance and opening of the flow path out of the neck 11 through the cap 2 as appropriate. The closer the angle is to the longitudinal axis of neck 11, the smaller the resulting gap for a given rise of cap 2 in direction of arrow 13. Angle 116 may be around 60° or around 70° or between those angles, but may be smaller if sealing force takes precedence over flow area.

The aim of the arrangement of the threads 211 is to configure them such that when the cap 2 is turned through a half turn, i.e. through approximately 180°, the cap opens the gap between closure portion 22 and end portion 113 of neck 11 to a sufficient degree that the flow path from the bore 12 through the apertures 23 to the chamber 24 is substantially equal to the flow path provided through orifice 25, or greater. To assist with this, it can be advantageous to provide a multi-start thread, optionally a two-start thread, but potentially having more than two-starts. As an example, if the pitch of the thread is around 8 mm, then a half turn of the cap 2 will provide a rise height of 4 mm. However, the dimensions of the neck 11, cap 2, and threads 211 and 112 can be arranged to provide whatever the desired rise may be.

The threads may further be configured such that further rotation of the cap 2 allows the cap to be completely removed from neck 11. Where desired, the threads can be configured such that the cap 2 may be removed with between a half turn and a full turn from its closed position, alternatively between a half turn and a three quarter turn, or between a three quarter turn and a full turn, or between a two-thirds turn up to any of the above upper limits, from its closed position. If the further amount required to remove the cap is too small, then the cap may not be securely held on the neck during pouring, if it is too great, then it may be difficult or impossible to remove, depending upon the form of the cap and the container to which it is attached. An angle of rotation from a closed position of the cap to one where it is free to be removed may be around 350 degrees.

Figure 2A:
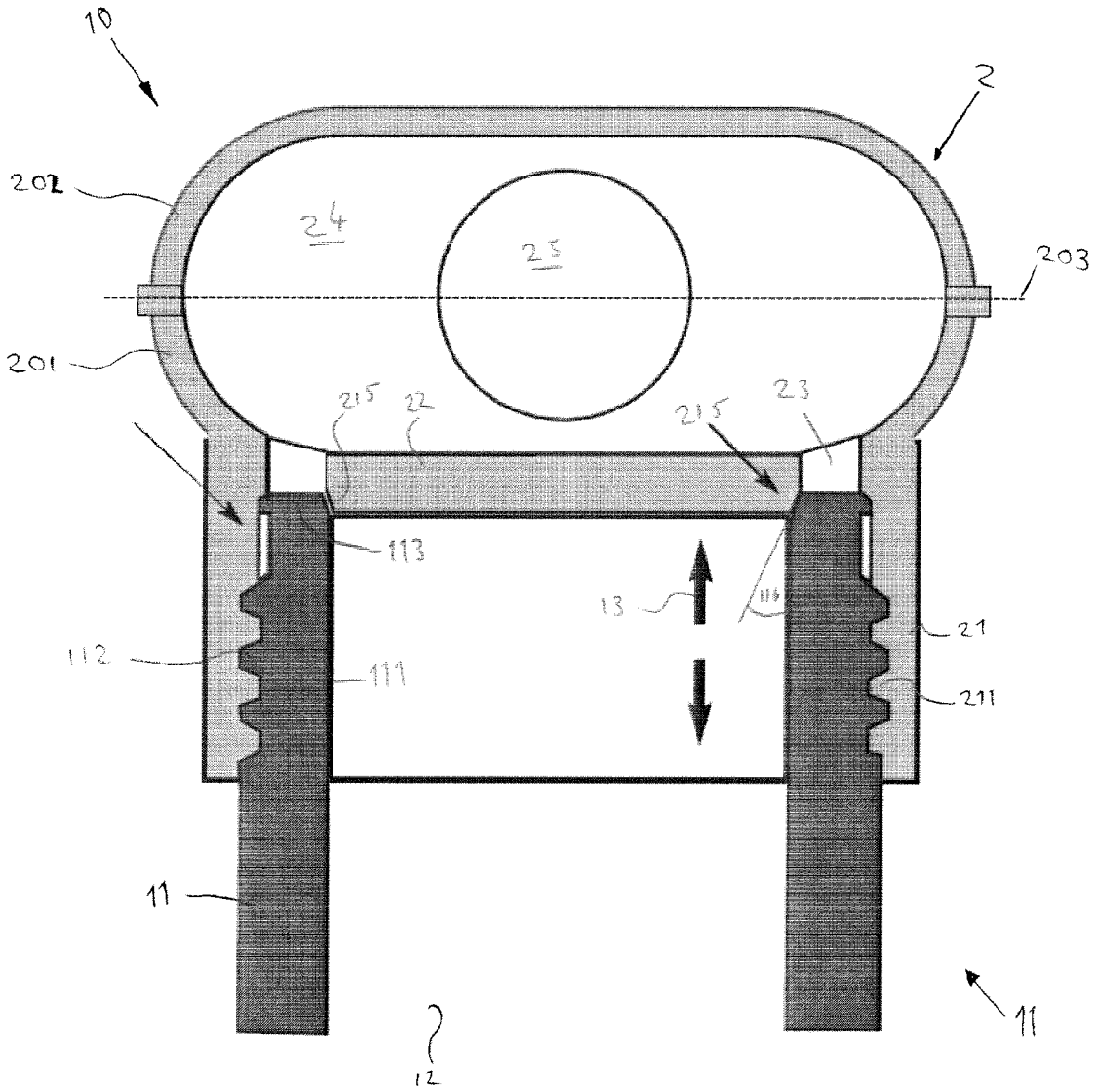
FIG. 2A shows an alternative closure arrangement incorporating features of the invention.

FIG. 2A shows an alternative arrangement for a closure arrangement, which is generally similar to the arrangement shown in FIG. 1, and equivalent features in FIG. 2A onwards are given the same reference numerals as used in FIG. 1. The arrangement is generally as described with respect to FIG. 1 with some small differences. In the arrangement of FIG. 2A, outlet aperture 25 is provided to allow an outward flow from chamber 24 in a direction substantially perpendicular to a longitudinal axis of bore 12 of neck 11 and of threads 211 and 112. Further, where in the example shown in FIG. 1, closure portion 22 is a separate element from the main body of cap 2, the closure portion 22 is integrally formed with the threaded portion 21. In order to achieve this configuration, it may be necessary to form cap 2 in two separate parts 201 and 202 which are divided by line 203. This can allow the parts to be injection moulded. After moulding, the two parts may be joined alone this line by hot plate welding or sonic welding, or any other suitable means of attaching the two parts together. Therefore, alternative methods of forming the chamber 24 incorporating the enclosure portion 22 are provided.

Figure 2B:
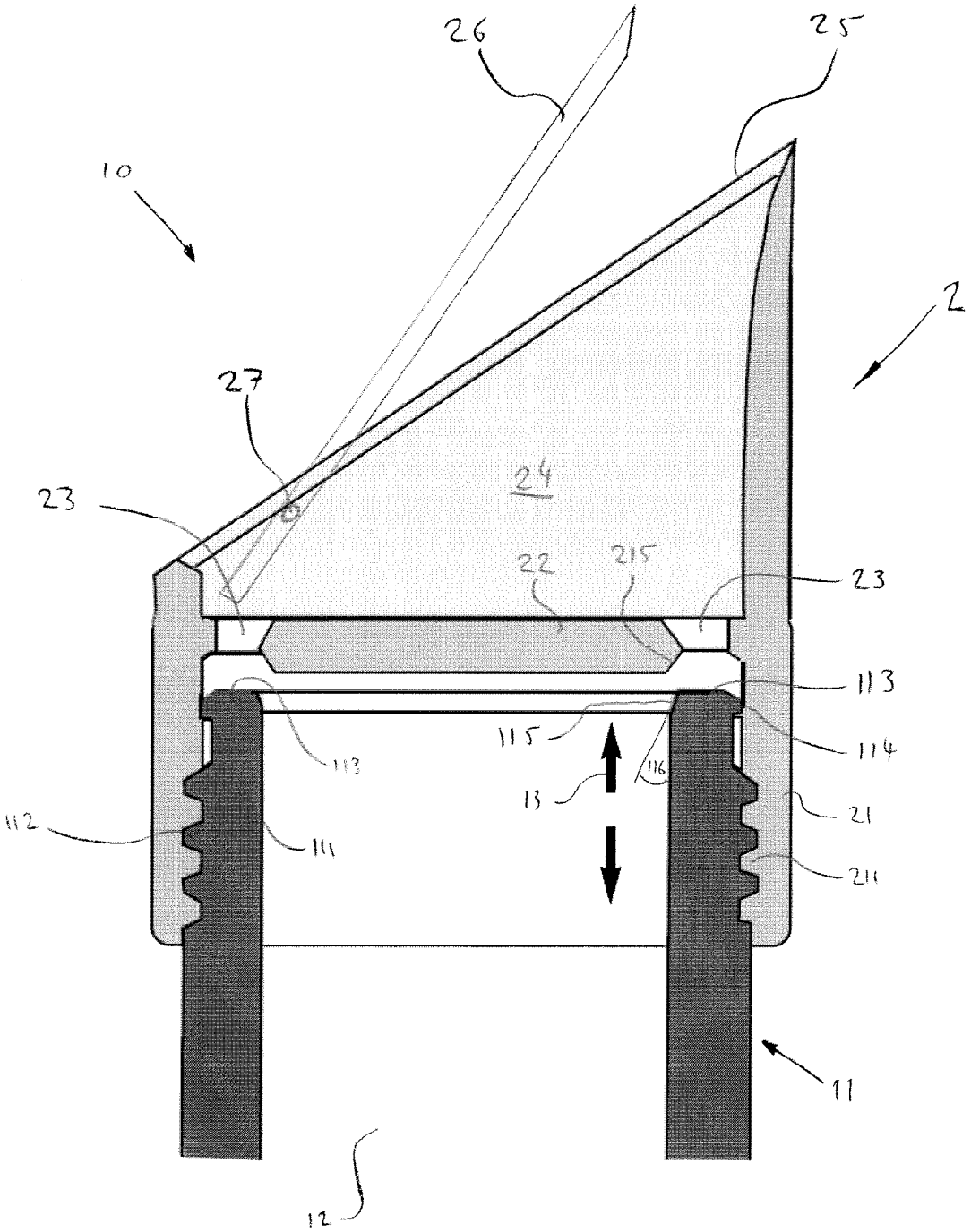
FIG. 2B shows a further alternative closure arrangement incorporating features of the invention.

FIG. 2B illustrates a further alternative closure arrangement, which is generally similar to the arrangements shown in FIGS. 1 and 2A. The closure illustrate in FIG. 2B is configured similarly and functions generally in the same manner as that shown in FIGS. 1 and 2A. The same reference numerals are used for similar features. However, some differences may be introduced as follows. Outlet aperture 25 may be substantially the same size, or larger, than the bore 12 of neck 11 and may, in particular, be substantially larger than the outer diameter of the array of apertures 23. The outer walls of the chamber 24 may be substantially parallel to the walls or threaded portions 111 of the neck 11. The chamber may therefore be configured as an open chamber having an open first end opposite the apertures 23. The open chamber may have a sloped edge at its open end, such that a short spout is formed and so the chamber may itself form an open spout. It may not be necessary in the examples shown for the closure to be removable in less than a single turn of the closure. In these cases it can be possible for the threaded portion to contain a single start thread, which is configured to allow a sufficient flow path, as defined above, when the cap is turned through more than a half turn of more than a full turn or even more. Some form of sealing means will be beneficial, in the form of interference fit threads 112, 211, or separate sealing means, arranged to prevent flow of fluid out of the container via the threads.

An advantage of the arrangement shown in FIG. 2B is that it can be moulded with simple open-shut tooling having a single axis of motion of the tooling parts. This can be improved if the outer walls of the cap are substantially parallel and the inner walls curve outwardly from the apertures toward the open end of the open spout. The cap may comprise no enclosed volumes, so that moulds can reach all outer surfaces of the cap without the need for complex tooling or manufacturing techniques. This can facilitate release of the cap from the tooling, while also providing the remaining advantages of the closure arrangement described above. The neck of any container to which the cap is provided may require increased strength through the use of stronger materials than are usual and may require modified dimensions to arrive at the correct configuration to provide the desired amount of rotation to open the apertures 23 and to release the cap 2 from the neck 11. The arrangement shown in FIG. 2B may be useful in application not requiring an elongate spout as shown in later Figures, such as for garden products of for fuel for vehicles not requiring a spout to open trap doors in the filler opening such as are present on modern road vehicles. The cap of any of the illustrated embodiments of the present invention may comprise a dust cap 26, illustrated here as implemented with the embodiment of FIG. 2B. However, a similar arrangement can be applied to the outlet apertures 25 of FIGS. 1, 2A, 2C and is particularly advantageous if the container to which the cap is applied is intended to be arranged with a vertical configuration, since dust or other dirt is more likely to collect in the cap in such a configuration, with the aperture 25 pointing substantially upwards. The dust cap may be pivotally mounted within the outlet aperture. The pivotal mount may be located within the outlet aperture and may be arranged away from a pouring side of the aperture such that the dust cap can be opened by force of liquid exiting the aperture when pouring and is reclosed by gravity once pouring has stopped and the closure arrangement is rotated towards a vertical configuration in which the spout is substantially upwardly facing, which may be essentially any position in which an axis of the cap and the neck is angled above the horizontal.

Figure 2C:
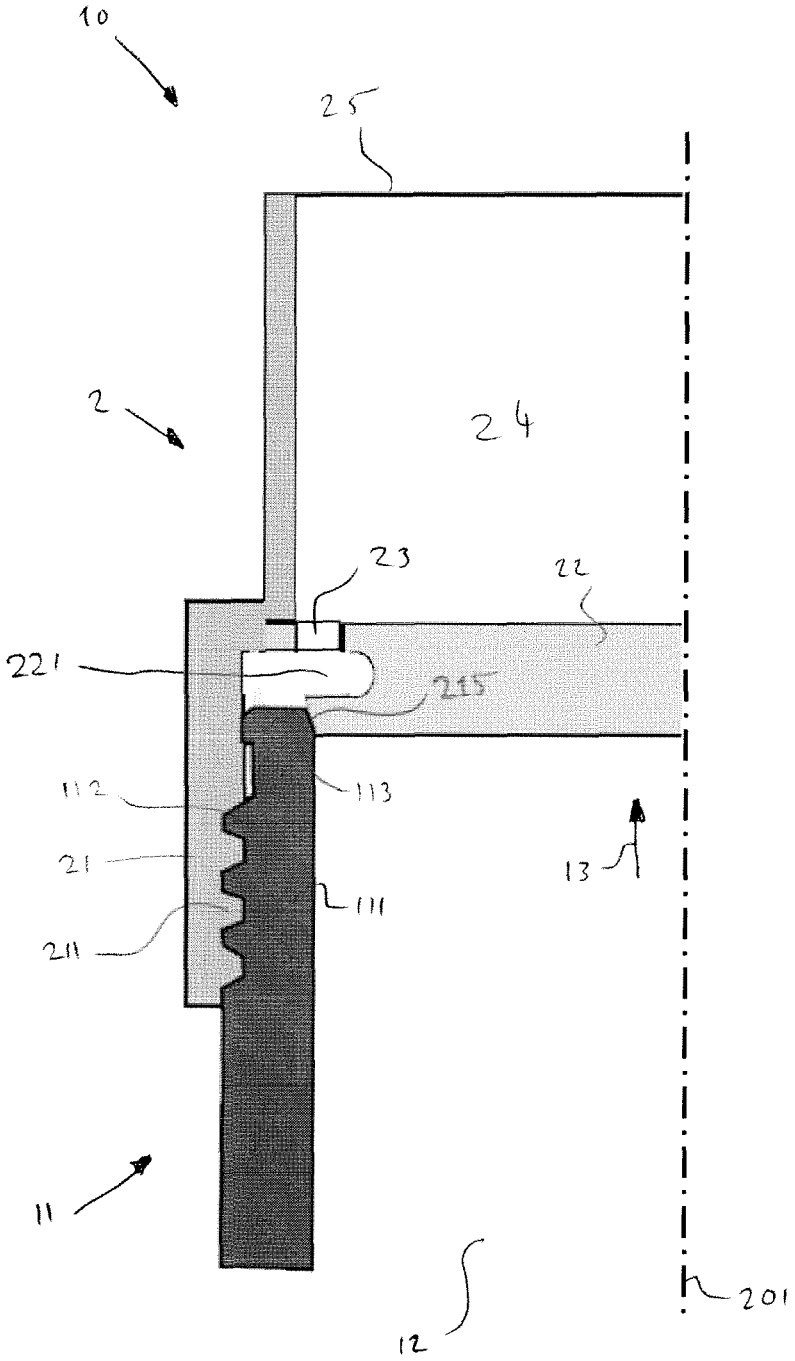
FIG. 2C shows a further alternative closure arrangement incorporating features of the invention

FIG. 2C illustrates an example where it may be desirable to reduce the diameter of the spout or of the chamber 24 with respect to the neck 11. The arrangement of FIG. 2C has some similar features to those described in FIGS. 1 to 2B, which are given the same reference numerals. The arrangement would be substantially symmetrical about the centre-line 201, with the exception of threads 112 and 211, since threads are not symmetrical in this way, but opposing corresponding features are provided to provide a functioning thread. The example of FIG. 2C provides a closure portion 22 which may be a separate component. Closure portion 22 may further have a void 221 in the direction of lift 13 of the cap between a sealing edge 215 of the closure portion and the array of apertures. This can allow the array of apertures 23 to be located at a diameter of the cap 2 which is less than the diameter of the neck 11 or of its bore 12. The sealing edge 215 may therefore be located at a diameter greater than that of the array of apertures 23.

Figure 3:
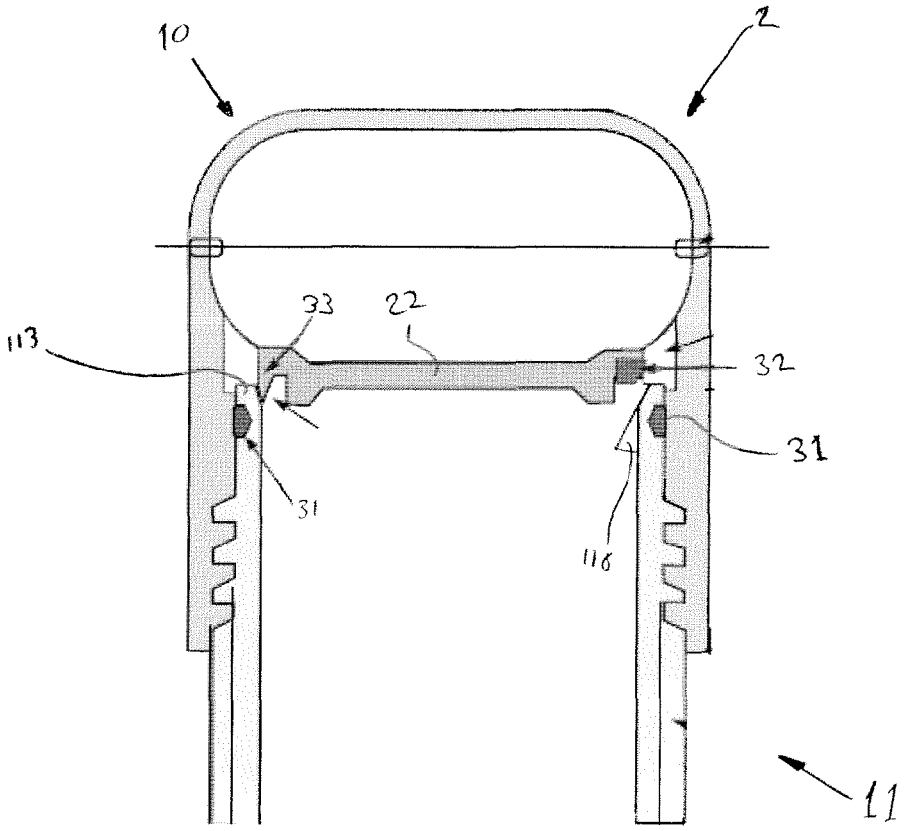
FIG. 3 shows further detail of various sealing means for a closure arrangement.

FIG. 3 illustrates alternative configurations for creating a seal between closure portion 22 and end portion 113 of neck 11. The sealing arrangements may be used with any of the examples described in FIGS. 1 and 2A/2B and later described in this description.

A resilient seal 31 may be provided between an outer wall of neck 11 and an inner wall of cap 2. Seal 31 may be a nitrile seal or any other suitable resilient sealing means.

Additionally, or alternatively, resilient seal 32 may be provided on closure portion 22. Although not illustrated as such in FIG. 3, this may be of a substantially O-ring shape such that when used, it would appear symmetrically on both sides of the closure portion 22 shown in FIG. 3.

A further alternative would be to mould a resilient sealing feature 33 around an outer edge of closure portion 22. This would allow a degree of resilience in the sealing interface between closure portion 22 and end portion 113 of neck 11 without the need for additional components. If provided, this feature 33 would extend all around an edge of closure portion 22 and thus would appear on both sides of closure portion 22 as illustrated in FIG. 3. FIG. 3 therefore is asymmetrical in appearance in order to illustrate the alternative sealing means 32 and 33 which may be used.

Figure 4:
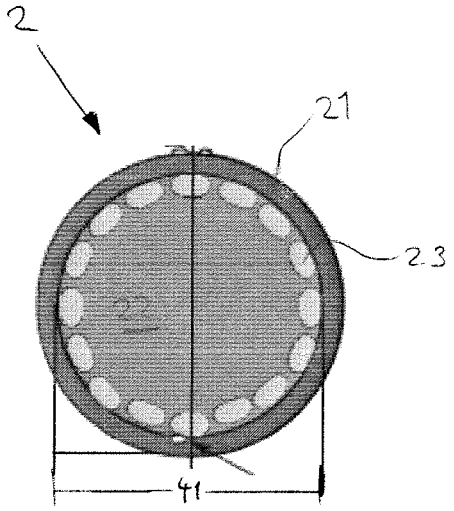
FIG. 4 shows detail of a closure portion of a cap or spout, for use in the present invention.

FIG. 4 shows a bottom view of a cap 2 for use in the present invention to illustrate features of the closure portion 22 and orifices 23. Orifices 23 are arranged in a substantially circular array adjacent the threaded portion 21 of the cap. The closure portion 22 is substantially solid in its central portion to provide a sealing function on end portion 1 and 3 of bore 12 of FIGS. 1 and 2. The apertures 23 are configured to provide the flow area substantially equal to that of a neck to which the cap can be applied. The cap has an inner diameter 41 substantially equal to the outer diameter of the neck 11. The apertures 23 are configured to have a width in a radial direction no greater than the thickness of the wall of the neck and, in particular, no greater than the width of an end portion 113 of the neck 11 as illustrated in FIG. 1. In this way the end portion 113 can abut against the apertures, or against the closure portion to one side of the array of apertures 23, and can therefore seal them against the passage of fluid.

In particular examples, a 25 mm neck, having a bore diameter 41 of 25 mm, will provide a 225 $mm^2$ flow area. This can be combined with an array of apertures, preferably 14 to 16 apertures, which are approximately 3 mm wide in a radial direction of the cap and approximately 6 mm long in a circumferential direction of the cap 2. This provides a total aperture flow area provided by apertures 23 of approximately 250 $mm^2$, which is greater than that provided by the bore 12 of the neck 11. In a further example, the neck may have a diameter 41 of 33 mm, which provides a flow area through the bore 12 of the neck of 256 $mm^2$. For this configuration, an array of 16 3 mm by 6 mm apertures can provide sufficient flow area to be as great as that of the neck.

An important sealing feature can be that the chamfers 115 and 215 of FIG. 1 meet in order to seal the apertures 23 from the bore 12 of the neck 11. The precise form of the end portion 113 may therefore not be important, so long as the champers 115 and 215 meet one another.

Figure 5:
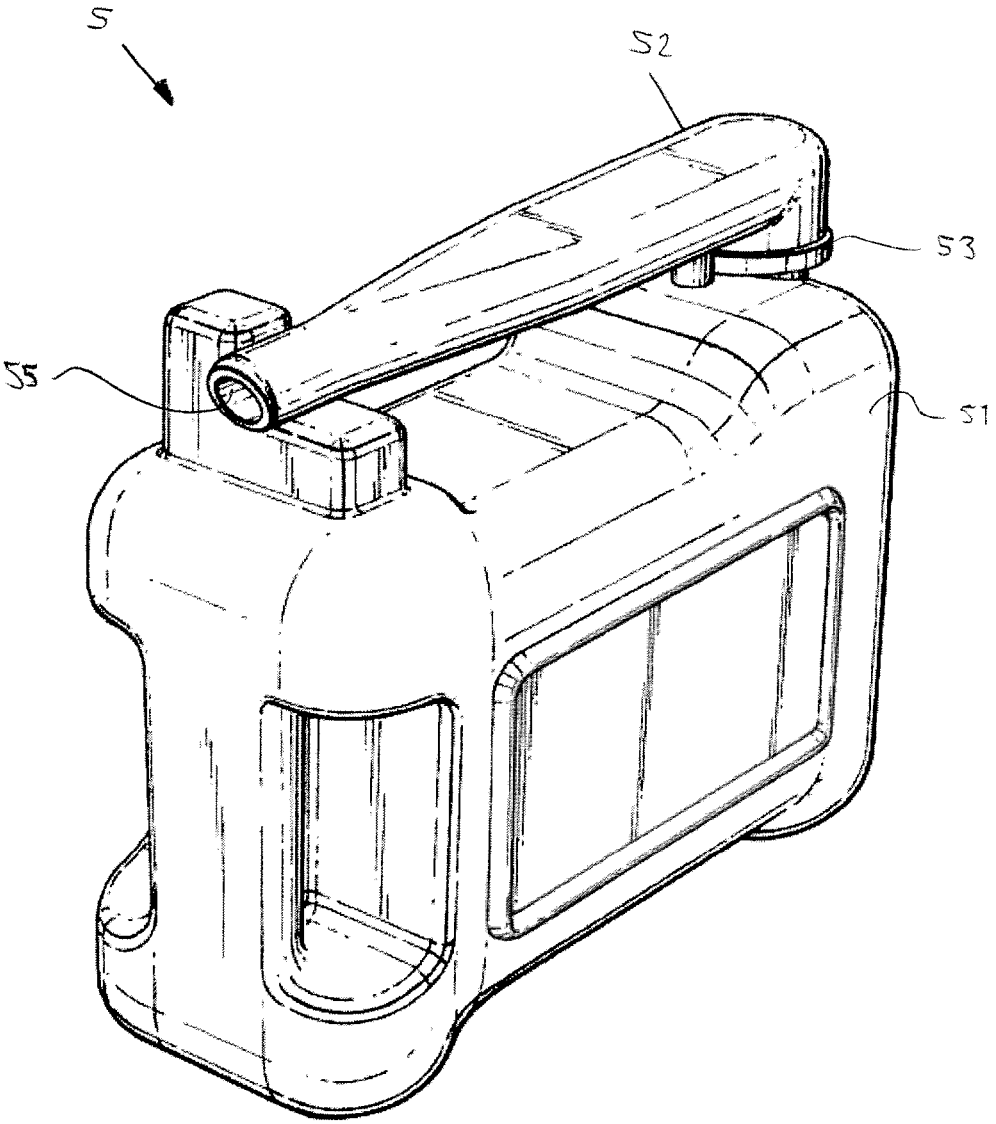
FIG. 5 shows a container suitable for use with the invention.

FIG. 5 illustrates one type of container in which the present invention may be implemented. In the illustrated example, the cap 2 is formed as a spout. The spout 2 is attached, in threaded engagement, to the body 51 of the container 5 and may be rotated about its threaded portion 53 relative to the container. The spout 2 has a relatively elongate chamber extending from the threaded portion 53 of the spout 52 to the outlet orifice 55. The spout 52 of the container 5 may be equipped with all of the features of the example closure shown in FIGS. 1 and 2, or any sub-set of those features. The closure arrangement of the container 5 may be configured such that the half turn of the spout 52 provides an equivalent flow area to the outlet orifice 55 as described above in relation to orifice 25 of the earlier figures. In this way, when the spout 52 is rotated into the position shown in FIG. 6 the apertures 23 of the closure portion are open, to allow fluid to flow from the bore 12, and fluid may be poured from the container 5 through spout 52.

The thread of the container may be arranged such that further rotation of the spout 52, optionally through a ¾ turn or more from the closed position, releases the spout completely from the container. The container can thus be refilled through the bore of the neck.

Figure 6:
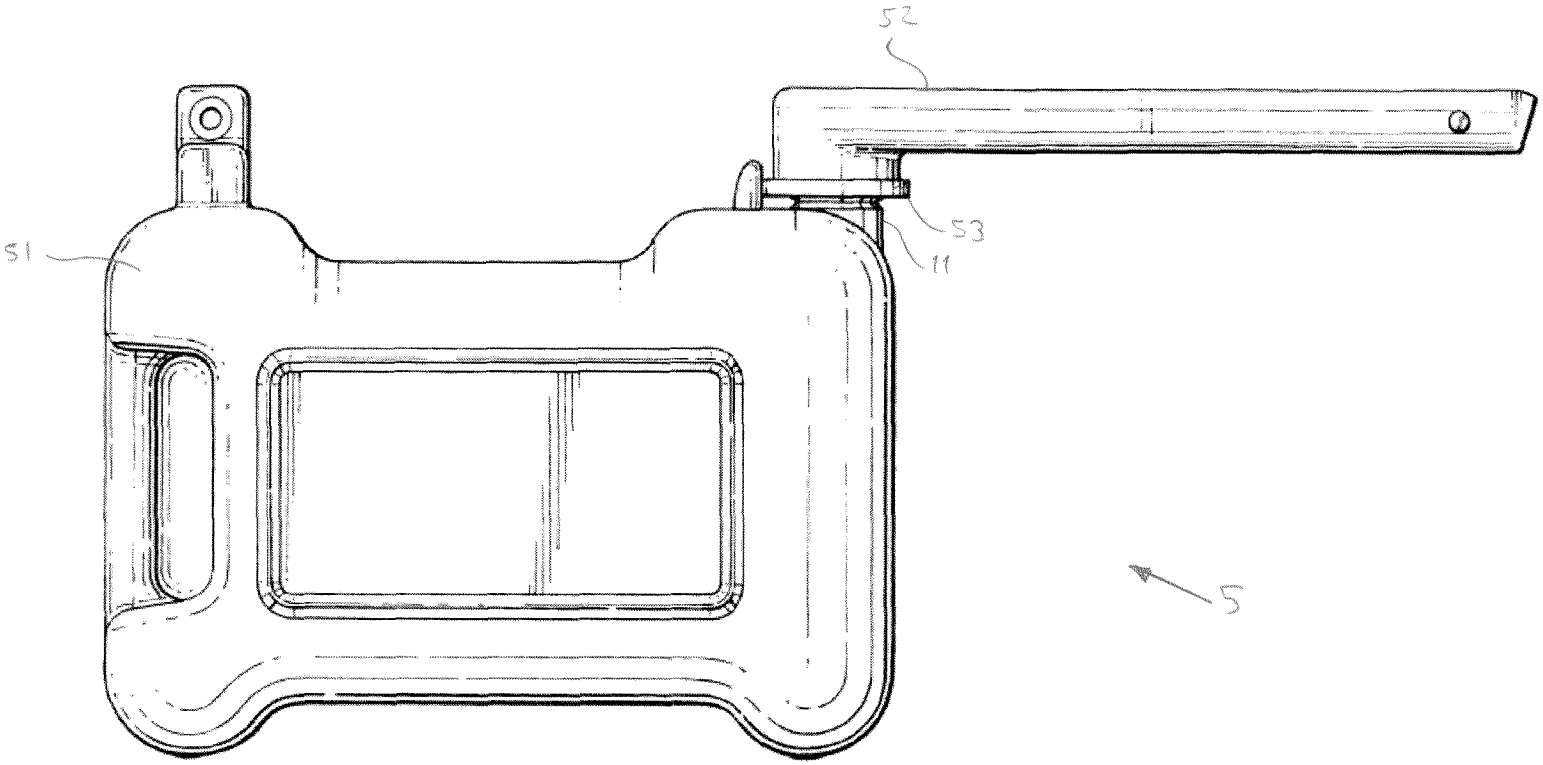
FIG. 6 shows an alternative view of a container for use with the invention.

A problem which may be encountered when pouring liquid from a container such as that shown in FIGS. 5 and 6 can be that so-called "glugging" occurs, since air must enter the container through the spout 52 at the same time as liquid must escape through the spout 52, so that a volume of poured liquid can be replaced with air.

Figure 7:
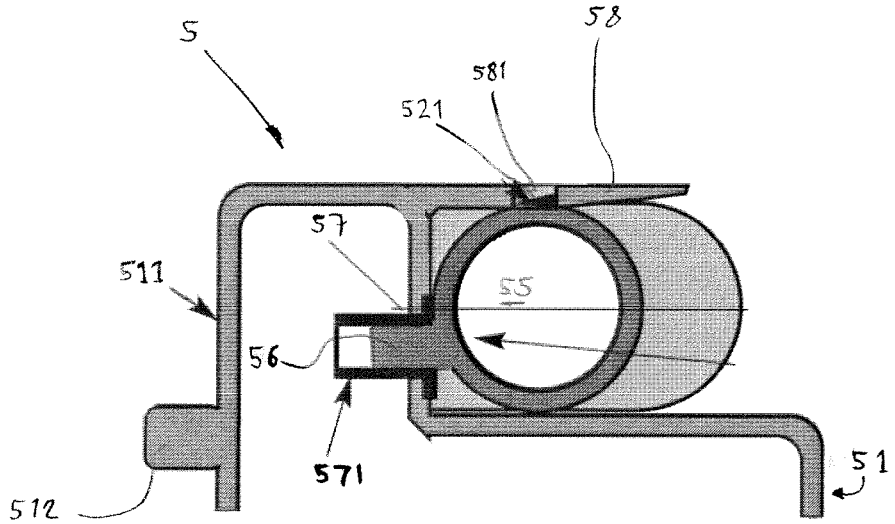
FIG. 7 shows details of a spout for use with the present invention.

FIG. 7 illustrates how an air vent may be provided in the body of the container 5, which is sealed when the spout 52 is in its closed position and is open to allow the passage of air when the spout 52 is in the open position, i.e. that illustrated in FIG. 6. In the illustrated example, the distal end of the spout 52, adjacent outlet orifice 55, is provided with a projection 56. The body 51 of the container is provided a spout engagement portion 511, which is configured to engage the distal end of the spout 52 when the spout is in its closed position. The engagement portion is provided with an air venting hole 57, which is optionally provided with a grommet 571 to aid in sealing the air vent 57 by engagement with the projection 56 of the spout. The spout engagement portion having the air vent opening is provided at an end of the container remote from the neck 11. The advantage of this location is that when liquid is poured from the neck 11, air can enter the container at a higher point in the container, so liquid is less likely to escape through the air vent unintentionally. A one-way valve in the air vent could also prevent liquid inadvertently being lost through the air-vent when the spout is in its open position.

Spout retaining means 58 are provided. In the illustrated example, an extension is attached to spout engaging portion 511 of the container body 51. Spout retaining means 58 are provided in the form of an opening 581 and the spout is provided with a corresponding engaging feature 521, which, when the spout is placed in its closed position, engages with opening 581 of spout retaining means 58. With the provision of such features, the spout 52 can be securely retained in its closed position, simultaneously sealing the air vent 57. The illustrated extension can be difficult to manufacture and so an alternative is to provide a feature similar to feature 521 on a side of the spout facing the body of the container and to provide a corresponding recess or sloped feature having a similar profile to feature 521 on the container body. This can provide the spout retaining means without a need for further additional moulded features such as the illustrated extension attached to the spout engaging portion 511. A further alternative spout retaining means can be a movable member attached to the body of the container or to the spout engaging portion. The movable member may be pivotable about a connection to the container. The retaining means may comprise biasing means for biasing at least a part of the retaining means toward an retaining position in which it engages and/or retains the spout. An additional feature when in the closed configuration, such as is illustrated in FIG. 5, is that the spout 52 may act as a convenient handle for the user.

Accordingly, the spout 52 has multiple functions of, acting as a handle, providing a seal for the neck of the container and providing a spout through which water may be poured from the container when in an open position. As described above, when the threads are configured to allow sufficient flow area with a half turn and to release the spout when the spout is rotated more than a half turn from its pouring position, then the position provides a dual function of acting as a removable and recloseable closure for the neck of the container and also as a spout through which liquid may be poured. Secondary spout engagement means may be provided to secure the spout in its closed position. In FIG. 7, this is provided by a protrusion 512 on the body. This is configured so that a tie may be passed around the spout 52 and subsequently around the protrusion 512 to secure the spout in the closed position.

Figure 8:
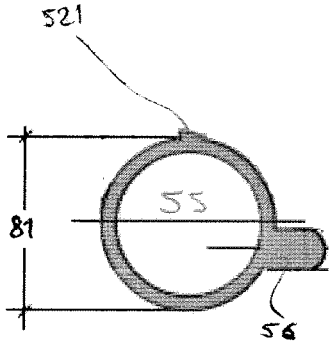
FIG. 8 shows further detail of a spout for use of the present invention.

FIG. 8 illustrates the outline of the distal end of the spout 52 in greater detail, where the container is intended for use in automotive applications, the diameter 81 of a distal end of the spout may be 20 mm. This allows the spout to enter into a 21 mm filler port, such as is used for a standard European unleaded petrol vehicle. Engaging feature 521 is shown in more detail, although in mirror-image with regard to FIG. 7. Engaging feature 581 has a first side which is substantially radial with respect to orifice 55 and a second side which is inclined with respect to the outer surface of the spout. This allows the spout to slide smoothly into its locked closed position by deforming feature 58 of FIG. 7, which is then clicked back into place when the opening 581 reaches the substantially radially oriented side of 521.

Figure 9:
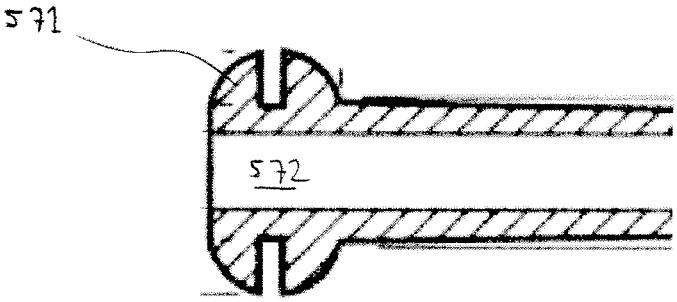
FIG. 9 shows detail of a grommet as incorporated in FIG. 7.

FIG. 9 illustrates a grommet 571 which may be used in the air vent 57 of FIG. 7. The grommet 571 may be made from a resilient material such as rubber, nitrile, or another material having similar resilience and sealing properties such that when it engages with protrusion 56 of the spout, a seal is created between the bore 572 of the grommet and the outer surface of the protrusion 56 to prevent the passage of liquid through the air vent.

Figure 10:
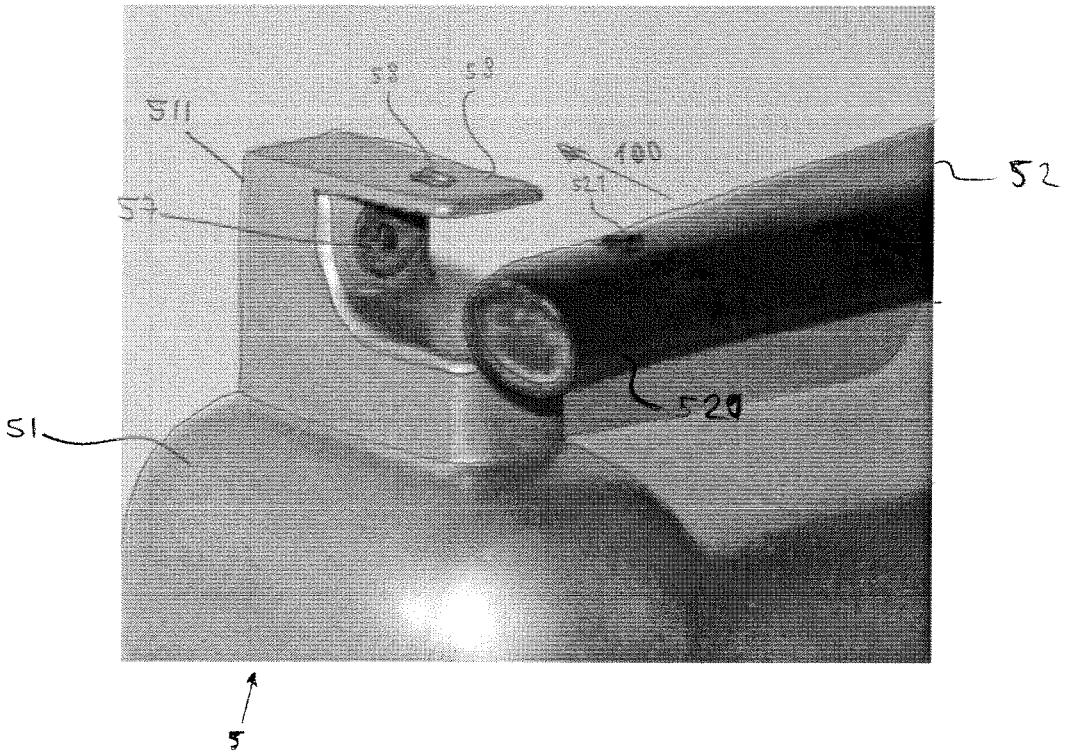
FIG. 10 shows detail of a container incorporating features of the invention.

FIG. 10 illustrates the spout 52 in a partially closed position, approaching its closed position, when the distal end 520 approaches engagement with the spout engaging portion 511 of the body 51 of container 5. As the spout 52 is advanced in a direction of arrow 100, the spout 52 engages with the spout engagement portion 511. The spout retaining means 58 and its opening 581 engage with the distal end 520 of the spout and the corresponding engaging portion 521 of the spout. Simultaneously, the protrusion 56 engages the air vent 57 to seal the air vent.

Figure 11:
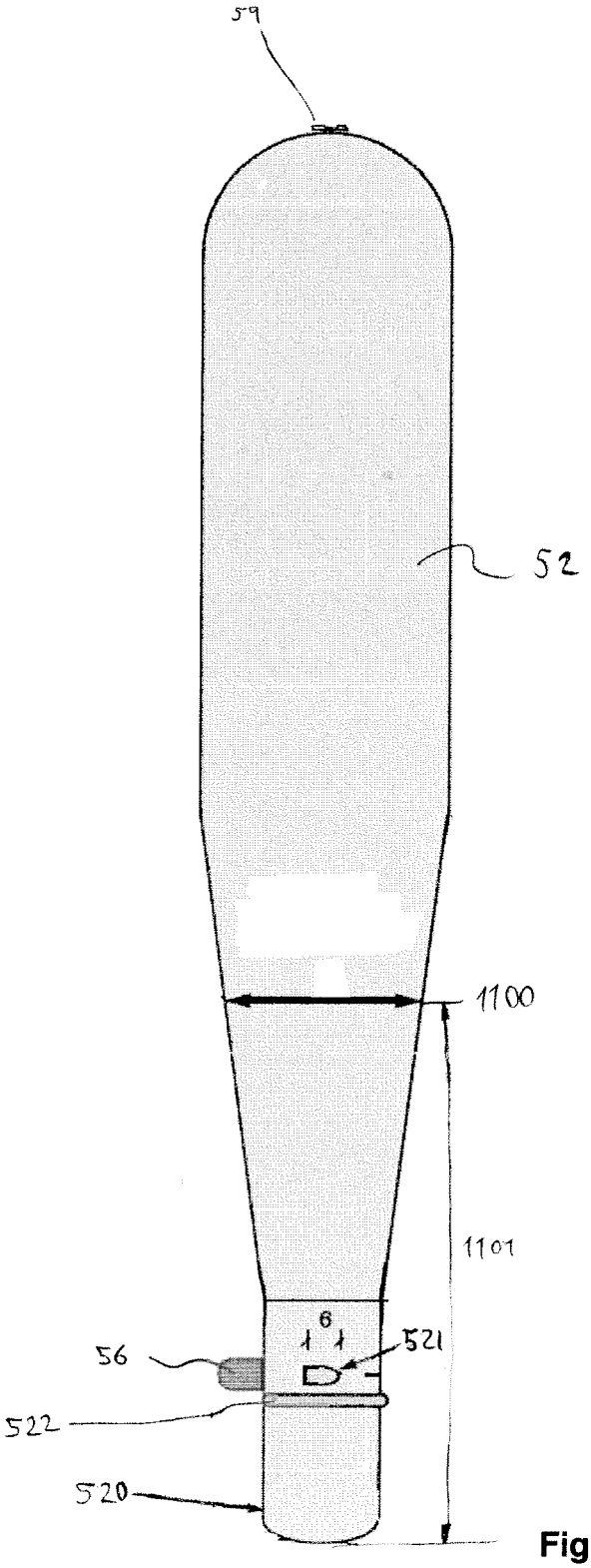
FIG. 11 shows details of a spout for use with the present invention.

FIG. 11 shows further details of a spout 52 which may be used with the container of FIG. 5. Positive location means are provided in the form of two projections 59. These may be configured to engage with a projection on the body of the container 5, so that the spout 52 is retained positively in its open position by engagement of the bumps 59 with the projection on the body (not shown).

Where the spout is intended for use in an automated applications, the diameter 1100 of the spout at distances 1101 of less than 10 cm should be less than around 36 mm. This allows the spout to sufficiently enter the fuel filler orifice of a vehicle an open any trap doors located in the filler port. An area of increased diameter 522 may be provided on the distal end 520 of the spout, between projection 56 and outlet orifice 55 of the spout, to prevent any orifice into which the spout is inserted from damaging projection 56.

Figure 12:
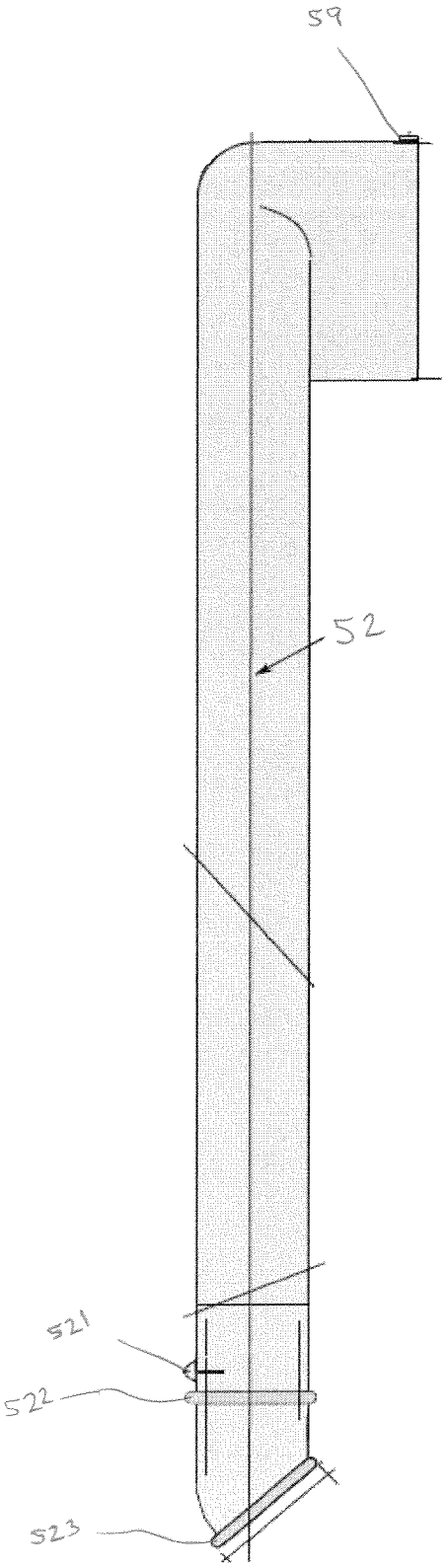
FIG. 12 shows further detail of a spout for use in the present invention.

FIG. 12 shows a side view of the spout 52 and illustrates a further diameter increasing feature 523 which may be applied to the distal end 520 of the spout 52. In general, an unleaded petrol pump filler tube is 21 mm diameter while leaded petrol or diesel tubes are 25 mm diameter, thereby preventing these latter 25 mm tube from inadvertently being inserted in a filler of an unleaded petrol vehicle. The 24 mm diameter tubes must not access into a petrol can or petrol car filler port, but could access a petrol or diesel aperture of larger diameter. There is therefore a need to be able to provide two versions of spout 52, one of which can enter into an unleaded petrol cap of a car or filler can, and another which cannot. By the provision of a diameter increasing feature such as 523 illustrated in FIG. 12, different versions of the spout 52 be created with a minimum of retooling during the manufacturing process.

Figure 13:
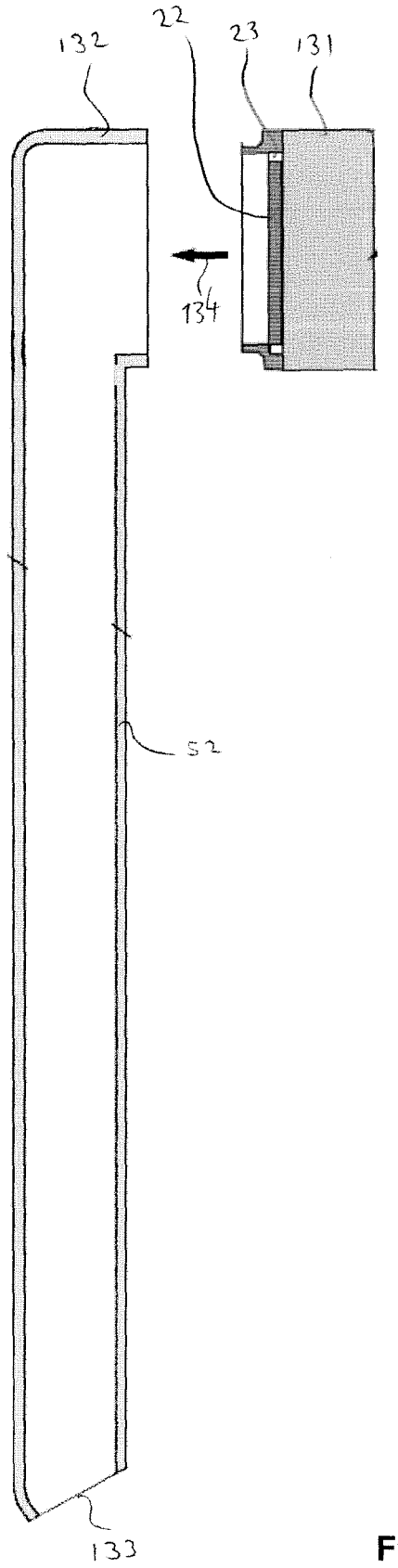
FIG. 13 shows an assembly for creating a spout for use with the present invention.

FIG. 13 illustrates an alternative construction of the spout 52, in which the threaded portion 131 is formed separately from the elongate chamber portion 132 extending to orifice 133. Closure portion 22, including apertures 23 of the closure arrangement illustrated in FIGS. 1 and 2, is formed on threaded portion 131 of the spout assembly. When the two portions 131 and 132 are assembled together in the direction of arrow 134, the two parts can subsequently be welded together by spin welding or any other suitable fixing means as described above.

Figure 14A:
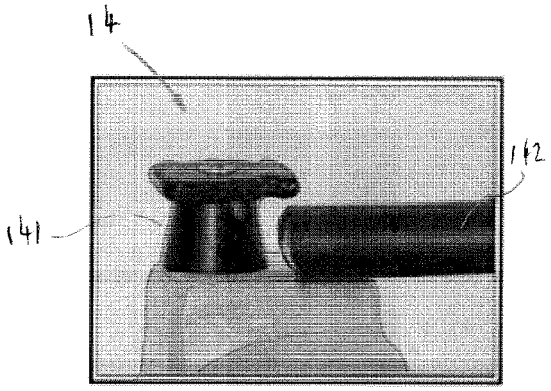
FIGS. 14A to 14D show an alternative arrangement for a spout and spout locking means for the invention.

FIGS. 14A to 14D show an alternative arrangement for providing the function of locking the spout of the present invention in a closed position and simultaneously sealing an air hole in the container. The arrangement 14 comprises an up-stand, or raised portion 141, arranged on a part of the container distal from the pouring opening, such that the raised portion 141 is substantially adjacent a closed position of the spout 142 when the spout is closed. FIG. 14A shows the arrangement in a partially opened configuration.

Figure 14B:
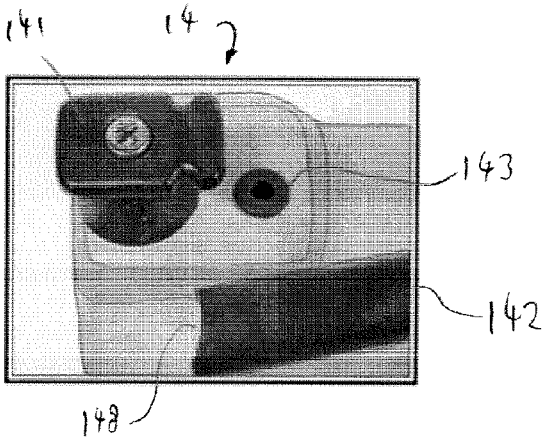

FIG. 14B shows an elevated view of the arrangement of FIG. 14A with the spout 142 opened a little further towards the open configuration. An air hole 143 with an optional grommet inserted in the air hole 143 can be seen facing upwardly on the container, or in a direction of the spout.

Figure 14C:
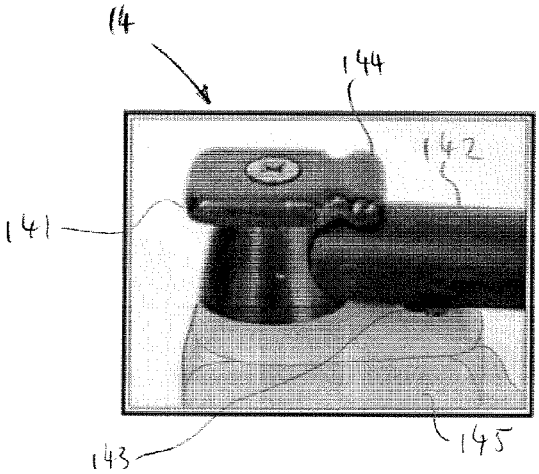
Figure 14D:
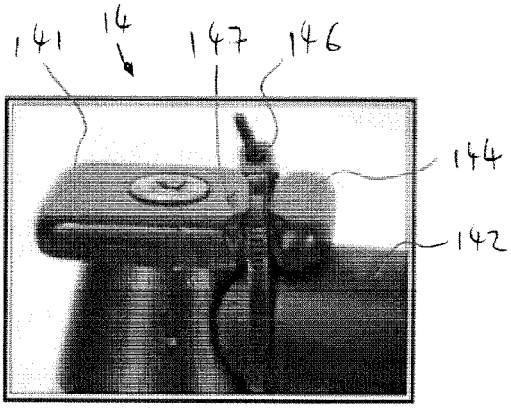

As can be seen in FIG. 14C, when the spout 142 is moved to a closed position, a distal end of the spout is arranged under a raised portion 141 of the container, which has a locking portion 144 which is arranged to engage the spout at a position opposite the main body of the container 145. In this arrangement, air hole 143 is sealed by the body of the spout 142. An optional bump or protrusion may be included in the underside of the body of the spout as shown in FIG. 14C, so that it can at least partially enter the air hole 143 to provide an improved air seal when the spout is in the closed position. As illustrated in FIG. 14D, a securing means such as a zip tie 146 will be included to secure the spout 142 to the locking portion 144 of the up stand or raised portion 141 of the container. The locking portion 144 may comprise securing means engagement portions 147, which may be recesses, holes or other suitable engagement means for helping to retain the securing means in position to secure the spout in the closed position. The spout may be further held in place by a frictional force between the locking portion 144 and the body of the spout 142. Further, as illustrated in FIG. 14B, the spout may have an end profile 148 which is shaped and configured to engage the outer profile of the up stand 141 to further retain the spout 142 in the closed position.

What is claimed is:

1. A closure arrangement for a liquid container comprising:

a neck comprising:

a bore for the flow of a liquid; and a thread, for threaded engagement with a cap, the neck having an end portion at the end of the bore;

a cap comprising:

a threaded portion;

a plurality of apertures for the flow of the liquid;

a spout formed integrally with the cap and arranged to collect and direct liquid flow from the apertures to an outlet of the spout;

a closure portion integrally formed with the cap and configured to close the bore of the neck at its end portion to prevent fluid flow through the apertures when the spout is in a closed position, the closure portion and the end portion of the neck comprising complementary circumferential chamfered surfaces that meet each other in the closed position, the chamfered surfaces being inclined with respect to a longitudinal opening direction of the cap along the neck, the circumferential chamfered surface of the end portion of the neck positioned outside of an outermost diameter of the bore; and means for preventing liquid from exiting the container via the threads;

wherein a flow area through the apertures is greater than or equal to a flow area through a gap between the end of the neck and the closure portion when the spout is turned to a fully open position such that the complementary chamfered surfaces are spaced apart for pouring the liquid, freely under gravity, from the container and out of the outlet of the wherein said liquid container comprises a spout engagement portion including a vent and said spout includes a protrusion, such that when said spout is rotated to said closed position said protrusion seals said vent and said spout is retained by said spout engagement portion to form a handle for said liquid container.

2. A closure arrangement according to claim 1, wherein the apertures are located entirely within an area defined by a circumference of the cap which is less than a circumference defined by the bore of the neck.

3. A closure arrangement according to claim 1, wherein the cap comprises a spout comprising at least one wall parallel to the threaded portion.

4. A closure arrangement according to claim 3, wherein the spout comprises an outlet orifice defining a circumference at least as great as that of a circumference defined by the array of the apertures.

5. A closure arrangement according to claim 1, wherein the cap comprises no enclosed volumes.

6. A closure arrangement according to claim 1, wherein at least one of the threads of the cap or the neck is a single start thread or a multi-start thread.

7. A closure arrangement according to claim 1, wherein at least one of the threads of the cap or the neck is arranged such that a half-turn, a three-quarter turn, or a full turn of the cap from its closed position opens a flow path through the apertures smaller than the flow path through the neck.

8. A closure arrangement according to claim 1, wherein the cap further comprises an outlet orifice and a chamber between the closure portion and the outlet orifice.

9. A closure arrangement according to claim 1, wherein the outlet orifice has a flow area greater than substantially half the flow area of the bore of the neck, or greater than around ¾ of the flow area of the bore of the neck, or greater than around ⅚ of the flow area of the bore of the neck.

10. A closure arrangement according to claim 1, wherein at least one of the neck and the cap comprises a thread arranged such that turning the cap from the closed position through between a half and a full turn releases the cap from the neck.

11. A closure arrangement according to claim 1, wherein the apertures are arranged to engage an end portion of the neck, such that the end portion of the neck substantially seals the apertures of the closure portion when the cap is screwed on to the thread.

12. A closure arrangement according to claim 1, wherein the sealing means is provided by the threads of the cap and the neck being configured to have an interference-fit, such that the threads of the neck and cap are substantially liquid-tight when engaged with one another.

13. A closure arrangement according to claim 1, wherein the sealing means is provided as a separate sealing member between the cap and the neck.

14. A closure arrangement according to claim 1, wherein the closure portion is engaged with the threaded portion by engagement means, such as by an interference fit, by threaded engagement, by fastenings, or by adhesive.

15. A closure arrangement according to claim 1, having an outlet aperture closure means for substantially preventing the ingress of dust or dirt into the outlet aperture, wherein:

the outlet aperture closure means is pivotally mounted within the outlet aperture; and the pivotal mount is arranged away from a pouring side of the aperture, such that the dust cap can be opened by force of liquid exiting the aperture when pouring and can be reclosed by gravity once pouring has stopped and the closure arrangement is rotated towards a vertical configuration in which the spout is substantially upwardly facing.

16. A closure arrangement according to claim 1, wherein the neck is integrally formed on a liquid container or a fuel can.

17. The closure arrangement according to claim 1, wherein a distal end of the spout is configured to engage the container in the closed position such that the spout acts as a handle.

18. The closure arrangement according to claim 17, wherein the spout comprises an elongate chamber extending transverse to the longitudinal opening direction between the threaded portion and the distal end.

19. The closure arrangement according to claim 1, wherein a distal end of the spout is configured to rotate about the threaded portion relative to the container from the closed position to the open position, and the spout is further rotated to remove the cap from the container.

* * * * *